United States Patent [19]

Procton

[11] Patent Number: 5,001,865

[45] Date of Patent: Mar. 26, 1991

[54] SEAL FOR ADJUSTABLE THRESHOLD

[75] Inventor: Brad I. Procton, High Point, N.C.

[73] Assignee: Endura Products, Inc., Greensboro, N.C.

[21] Appl. No.: 513,564

[22] Filed: Apr. 24, 1990

[51] Int. Cl.[5] ..... E06B 1/70

[52] U.S. Cl. ..... 49/469; 49/489

[58] Field of Search ..... 49/467–471, 49/489

[56] References Cited

U.S. PATENT DOCUMENTS

| | | | |
|---|---|---|---|
| 2,839,796 | 6/1958 | Quoss | 49/469 X |
| 2,933,782 | 4/1960 | Cornell | 49/469 |
| 3,079,653 | 3/1963 | Cornell | 49/469 X |
| 3,762,100 | 10/1973 | Kempel | 49/468 |
| 4,287,684 | 9/1981 | McKann | 49/469 X |
| 4,538,380 | 9/1985 | Colliander | 49/489 X |
| 4,658,548 | 4/1987 | Gerritsen | 49/489 X |

*Primary Examiner*—Rodney M. Lindsey
*Assistant Examiner*—Jerry Redman

[57] ABSTRACT

A molded seal for a door threshold assembly includes an insert which is T-shaped in cross section and attached to the top edge of the T is a resiliently compressible tube-like follower. The follower is covered by a durable, water impervious skin and the insert is positioned within the base of the threshod assembly and the follower is positioned contiguous to a movable threshold member. The tubular portion of the seal will pivot and roll along the movable member as it is raised or lowered thereby insuring a water tight seal between the movable member and the threshold base.

14 Claims, 2 Drawing Sheets

SEAL FOR ADJUSTABLE THRESHOLD

BACKGROUND OF THE INVENTION

1. Field Of The Invention

The invention described herein pertains to seals for doorway thresholds and particularly pertains to weather seals for thresholds which vertically adjust to compensate for unevenness between the door and threshold to provide a weathertight entry.

2. Description Of The Prior Art And Objectives Of The Invention

In recent years manufacturers of door thresholds and the like have attempted to improve the efficiency and reduce the labor costs of threshold installations. One of the recent advancements in the field is the production of thresholds which include a vertically movable member which can be easily adjusted by installers on-site to compensate for doors that are "high cut" or are out of square. While such adjustable thresholds have been found to work very well under ideal circumstances, once they are installed and are under actual use conditions, problems have developed pertaining to the seal components which make the thresholds weathertight. For example, adjustable threshold seals are generally manufactured of a limited compression or non-resilient polymeric material such as a polyvinyl choloride composition, which may fit and seal perfectly upon installation, but due to its limited resiliency be found later, after a few months of use to have shrunk, contracted, or lost its resiliency thereby losing its sealing characteristics. Also, some vertically adjustable thresholds are tightly sealed when in a downward position, yet when they are adjusted by raising at the job site, the seal does not then adequately close the space between the vertically movable member and the stationary base, thereby creating a potential moisture entry. In addition, conventional vinyl seals have been found to split or crack when trimmed during manufacture or at the installation site and water and other debris have entered a cracked seal causing a variety of problems. Imperfect seals, under storm or windy conditions can allow damaging water to enter the house, building or other enclosure, much to the dismay of the building occupants.

Thus, with the problems and disadvantages associated with conventional adjustable threshold seals, the present invention was conceived and one of its objectives is to provide a seal which can be easily installed and replaced and overcomes the problems associated with prior art threshold seals.

It is another objective of the present invention to provide a threshold seal which includes a resilient compressible portion which will provide a weathertight seal when positioned contiguous to a vertically movable member, regardless of the position of the vertical member relative to its fixed base.

It is yet another objective of the present invention to provide a threshold seal in which the compressible member acts as a follower which will move or roll relative to the motion of the movable member during adjustment thereof.

It is still another objective of the present invention to provide a seal for an adjustable threshold which comprises a resilient tubular member formed from a synthetic polymer foam having a water impervious, durable outer skin.

It is a further objective of the present invention to provide a threshold seal which is formed from a polymeric material which includes a non-compressible somewhat T-shaped cross section portion which is integrally joined to a resilient compressible tubular portion along the top of the "T".

Various other objectives and advantages of the present invention will become apparent to those skilled in the art as details are fully revealed below.

SUMMARY OF THE INVENTION

The aforesaid and other objectives are realized for an adjustable threshold assembly by integrally forming a seal which includes a relatively non-compressible insert portion and a compressible tubular portion formed from a foam material covered by a water impervious, durable skin. The non-compressible portion provides a means for insertion into a fixed base of an adjustable threshold assembly while the resiliently compressible tubular portion is positioned contiguous to the vertically movable threshold member. Thus, as the movable member is adjusted on site to fit a particular door bottom, the tubular portion acts as a follower and will remain in sealing contact by moving along the outer surface of the movable member to insure a weathertight seal between the movable member and the fixed base. During vertical adjustment of the movable member the compressible portion of the seal will pivot along its fixed point of the insert or non-compressible body portion of the seal.

DESCRIPTION OF THE PREFERRED EMBODIMENT

Figure 2:
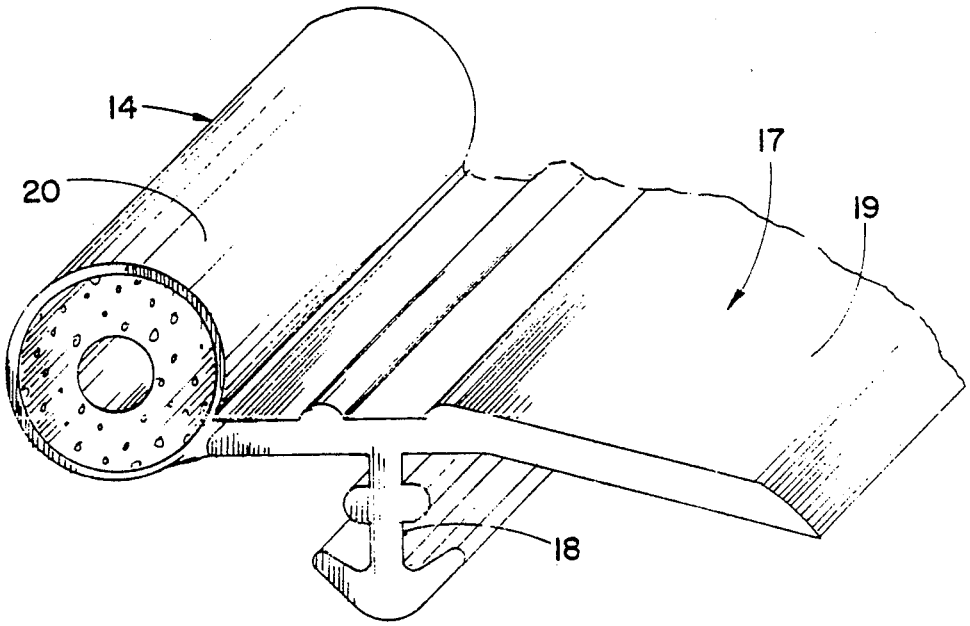
FIG. 2 demonstrates in partial perspective fashion the seal having a body portion and a tubular follower portion removed from the threshold apparatus.

The preferred form of the invention is demonstrated in FIG. 2 which includes an adjustable threshold having a seal formed from a synthetic polyolefin material such as sold under the SANTOPRENE trademark of Monsanto Chemical Company of St. Louis, Mo. SANTOPRENE can be formed as a closed cell expanded foam, and is compressible to eighty-eight percent of its normal volume. The outer surface of the compressible member is covered with a thin, flexible, planar, non-foamed layer of SANTOPRENE. The seal includes an insert body portion which is substantially T-shaped and is formed from a synthetic polymer material such as polypropylene. The follower portion of the seal as shown in FIG. 2 consists of a hollow tubular shape which will "roll" along and pivot at its attachment point of the non-compressible body insert.

DETAILED DESCRIPTION OF THE DRAWINGS AND OPERATION OF THE INVENTION

Figure 1:
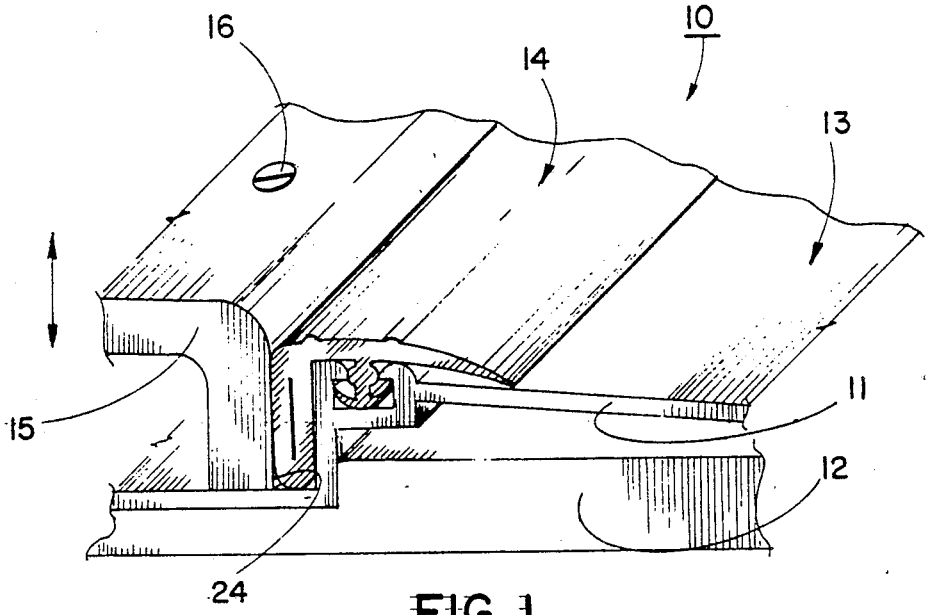
FIG. 1 shows a partial perspective view of a conventional adjustable threshold with the seal of the invention mounted therein.

For a better understanding of the invention and its operation, turning now to the drawings, FIG. 1 demonstrates conventional threshold apparatus 10 which includes a fixed aluminum extrusion 11 shown in conjunction with wooden plate 12 which together form a fixed base 13 into which seal 14 is mounted. Vertically movable member 15 is joined to base 13 by embedded adjusting means 16 or the like. By rotating adjusting means 16, movable member 15 will conventionally move upwardly or downwardly as desired to accommodate the bottom of a door (not shown) in FIG. 1.

Figure 3:
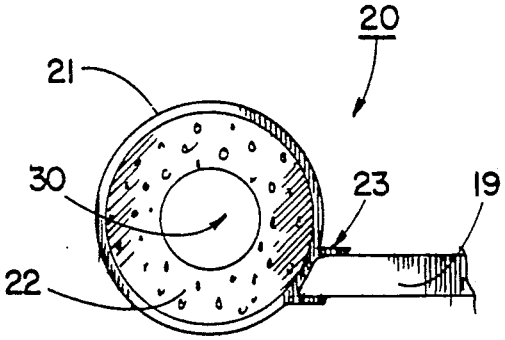
FIG. 3 demonstrates an enlarged cross-sectional end view of the compressible follower of the seal as shown in FIG. 2.

In FIG. 2, polymeric seal 14 is seen in a perspective configuration and includes insert body portion 17. Body portion 17 is substantially T-shaped in cross-sectional view and includes a vertical post 18 and top transverse member 19. Vertical post 18 and top transverse member 19 may be formed from a polypropylene monomer or other suitable materials as available and are relatively non-compressible as compared with tubular or bulbous portion 20 as seen in FIGS. 2 and 3. As earlier explained, tubular portion 20 is formed from a foamed polyolefin material covered with a thin, flexible skin 21 and can be co-extruded with insert body portion 17 as one integral unit.

Figure 6:
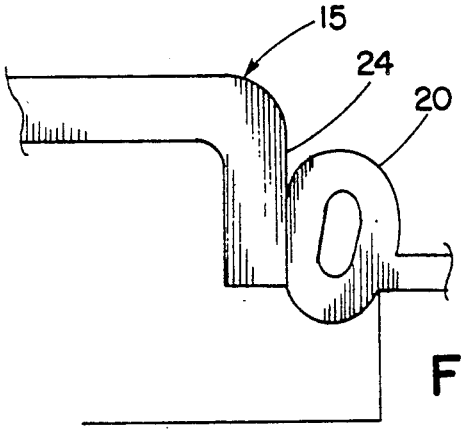
FIG. 6 demonstrates the threshold member and follower in a further raised position.
Figure 5:
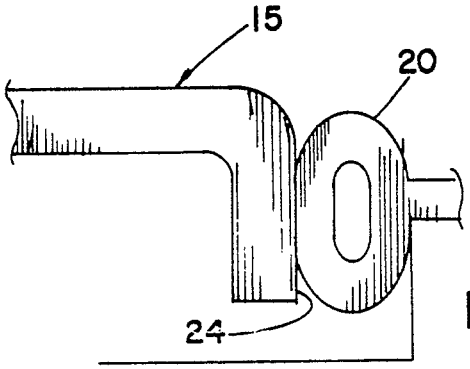
FIG. 5 demonstrates in schematic fashion the movement of the compressible follower as the movable threshold member is raised.
Figure 4:
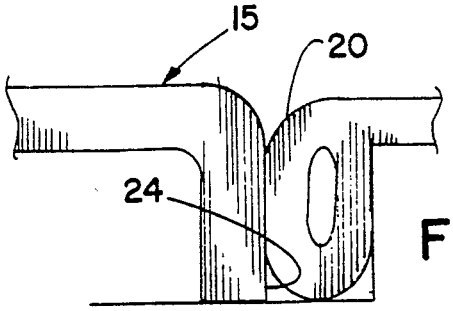
FIG. 4 illustrates the downward position of the vertically movable threshold member with the follower compressed.

FIG. 3 demonstrates an end view of tubular portion 20 in which flexible polyolefin skin 21 covers open cell foam 22. Foam 22 is likewise formed from a polyolefin and is resiliently compressible to eighty-eight percent of its original volume. Flexible skin 21 prevents moisture or debris entrapment in foam 22 and prevents wear and degradation to foam 22. Skin 21 is sealed against or joined to transverse member 19 at juncture 23 as illustrated in FIG. 3. Tubular portion 20 provides a means to follow movable member 15 as depicted in FIGS. 4 through 6. As pictured therein, member 15 adjusts from a lowered position in FIG. 4 to an intermediate, upward position in FIG. 5 and to a fully raised posture in FIG. 6. Tubular portion 20 follows said movement as it frictionally engages and rolls along wall 24 of movable member 15. As further demonstrated in FIGS. 4 through 6, tubular member 20 "rolls" along wall 24 as member 15 slides upwardly and downwardly until it reaches its upward limit as shown in FIG. 6 or reaches it downward limit as shown in FIG. 4.

Since tubular portion 20 is resiliently compressible, a water tight seal is provided between stationary base 13 and movable member 15 even during periods of cold weather when materials such as polyvinyl choloride, aluminum or other affected materials will somewhat shrink, contract or harden and close resiliency. Also, tubular portion 20 compresses in the event either or both movable member 15 or stationary base member 13 expand such as may occur with certain materials during high temperature summertime conditions.

It has been found that tubular portion 20 which forms a cross-sectional bulbous appendage to insert body portion 17 will also compensate for an irregular surface of wall 24 of movable member 15. As threshold apparatus 10 with seal 14 therein is shipped to a typical construction job site and installed in the doorway, movable member 15 can be raised or lowered to accommodate for a particular bottom door height or unevenness. Since movable member 15 is secured in place by adjusting means 16, the installer does not have to be concerned with subsequent adjusting of seal 14 because tubular portion 20 will automatically follow the vertical movement of member 15 and provide the necessary moisture barricade. Thus, if movable member 15 is later readjusted, seal 14 through tubular portion 20 will again automatically adjust to barricade and prevent moisture entry and entrapment between fixed base 13 and vertically movable member 15.

Compressible tubular portion 20 with hollow central cavity 30 has been found to perform satisfactory under a variety of conditions although it should be understood that other configurations, utilizing the resiliency and compression features of polyolefin foam 22 may also be found to work well under specific conditions.

The illustrations and examples provided herein are for explanatory purposes only and are not intended to limit the scope of the appended claims.

I claim:

1. An improved seal for an adjustable threshold, said threshold having a stationary base and a movable member, said seal having a body formed of a relatively non-compressible material, said body attached to said base for positioning between said base and said movable member to prevent moisture from entering therebetween, the improvement comprising: means to follow said movable member, said follower means pivotally attached to said seal body, and contacting said movable member whereby movement of said movable member will cause said follower means to pivot thereagainst.

2. An improved seal as claimed in claim 1 wherein said follower means is compressible.

3. An improved seal as claimed in claim 1 wherein said follower means has a bulbous cross section.

4. An improved seal as claimed in claim 1 wherein said follower means comprises a foam material.

5. An improved seal as claimed in claim 4 wherein said foam material includes a durable water impervious cover.

6. An improved seal as claimed in claim 1 wherein said follower means comprises a tubular member.

7. An improved seal as claimed in claim 1 wherein said follower means is formed from a polymeric substance.

8. An improved seal as claimed in claim 7 wherein said follower means is formed from a polyolefin.

9. A seal, for an adjustable threshold having a moveable member comprising: an insert said insert having a generally T-shaped cross section, said T-shaped insert comprising a vertical post, a transverse member, said transverse member comprising a pair of outer edges, said transverse member attached to said vertical post, a follower, said follower having a tubular shape with a bulbous cross-sectional appearance, said follower pivotally attached along one outer edge of said transverse member, said follower formed from a compressible material, said follower for contacting said moveable member.

10. A seal as claimed in claim 9 wherein said T-shaped insert is substantially non-compressible.

11. A seal as claimed in claim 9 wherein said follower comprises a hollow foam tube.

12. A seal as claimed in claim 11 wherein said follower is formed from a polymeric substance.

13. A seal as claimed in claim 9 wherein said follower is formed from a polyolefin.

14. A seal as claimed in claim 9 wherein said follower comprises a durable water impervious covering.

* * * * *